US007934466B2

(12) United States Patent
Collmer et al.

(10) Patent No.: US 7,934,466 B2
(45) Date of Patent: May 3, 2011

(54) COATING PLANT AND ASSOCIATED COATING PROCESS

(75) Inventors: Andreas Collmer, Stuttgart (DE); Wilhelm Hofmann, Stuttgart (DE)

(73) Assignee: Durr Systems Inc., Auburn Hills, MI (US)

( * ) Notice: Subject to any disclaimer, the term of this patent is extended or adjusted under 35 U.S.C. 154(b) by 866 days.

(21) Appl. No.: 11/681,603

(22) Filed: Mar. 2, 2007

(65) Prior Publication Data

US 2007/0207260 A1 Sep. 6, 2007

Related U.S. Application Data

(60) Provisional application No. 60/778,342, filed on Mar. 2, 2006.

(51) Int. Cl.
*B05C 5/02* (2006.01)
*B05D 1/02* (2006.01)

(52) U.S. Cl. ..... 118/663; 118/683; 118/684; 118/629; 118/323; 239/67; 239/68; 239/69; 239/71; 239/126; 222/52; 222/55; 222/63; 222/71

(58) Field of Classification Search ..... 118/663, 118/683, 684, 629, 323, 300; 222/52, 55, 222/71, 63; 239/126, 67–69, 71; 427/421.1, 427/427.2, 8

See application file for complete search history.

(56) References Cited

U.S. PATENT DOCUMENTS

| | | | | |
|---|---|---|---|---|
| 3,584,977 | A | 6/1971 | Coleman | |
| 4,822,647 | A * | 4/1989 | Nozaki et al. | 427/427.2 |
| 5,065,695 | A * | 11/1991 | Baron et al. | 118/688 |
| 6,726,773 | B1 * | 4/2004 | Yanagita et al. | 118/679 |

FOREIGN PATENT DOCUMENTS

| | | | |
|---|---|---|---|
| DE | 69814532 | T2 | 4/2004 |
| EP | 0697317 | A1 | 2/1996 |
| EP | 1287900 | A2 | 3/2003 |
| EP | 1376289 | A1 | 1/2004 |
| EP | 1437520 | A2 | 7/2004 |
| EP | 1481736 | A2 | 12/2004 |
| JP | 6111963 | A | 4/1994 |
| JP | 929147 | | 2/1997 |
| WO | WO9835761 | | 8/1998 |
| WO | WO2005072881 | A1 | 8/2005 |

OTHER PUBLICATIONS

Technisches Handbuch, Farbmengenregelung, Stand Feb. 1994, Ident-Nr.:G051_01.DE, Durr GmbH, Produktbereich Lackiertechnik-Applikation.

* cited by examiner

*Primary Examiner* — Laura Edwards
(74) *Attorney, Agent, or Firm* — Rader Fishman & Grauer

(57) ABSTRACT

The invention concerns a coating plant for the coating of construction units with a coating medium, in particular a paint system for the lacquer finish of motor vehicle body parts, with a dosing pump, the coating medium supplied with a certain delivery ($F_m$) proportioned, and a pressure control valve arranged upstream before the dosing pump to adjust a coating medium pressure (p v) at the entrance of the dosing pump, as well as a control unit to adjust the pressure control valve a controlled variable of the pressure difference (Δp) through the dosing pump independently of the delivery of the dosing pump and the changing viscosity of the lacquers to an essentially constant desired value ($\Delta p_{TARGET}$).

12 Claims, 4 Drawing Sheets

COATING PLANT AND ASSOCIATED COATING PROCESS

CROSS-REFERENCE TO RELATED APPLICATIONS

This application claims the benefit of the provisional patent application 60/778,342 for COATING PLANT AND ASSOCIATED COATING PROCESS, filed on Mar. 2, 2006 which is incorporated by reference herein its entirety. This claim is made under 35 U.S.C. §119(e); 37 C.F.R. §1.78; and 65 FR 50093.

FIELD OF THE INVENTION

The present disclosure relates to a coating plant for coating components with a coating means, specifically a paint plant for painting motor vehicle body parts and an associated operating process in according with the dependent claims.

BACKGROUND

Such a coating plant is known from EP 1 287 900 A2 and from "Technical Manual for Paint Volume Control", page 32 (1994) from the Dürr Company in which a rotary atomizer is supplied with the coating means to be applied through a paint pressure regulator and a metering pump. The pressure of the coating means ahead of and behind the metering pump is measured by pressure sensors and sent to electronic controls which actuate the paint pressure regulator through a pressure control valve configured as a proportional valve. In the case of this known coating plant, either the output pressure of the paint pressure regulator or the paint flow rate is regulated as the control variable.

The disadvantage of the previously described known coating plant-bis the wear on the metering pump and the paint pressure regulator, which results in a short service life for these components. This applies in particular to the paint pressure regulator, the seal ring of which exhibits extremely severe erosion after a certain operating time.

In addition, with the conventional coating plants, inaccuracies in metering may occur which, in an extreme case, result in cessation of the paint flow which shows up as a paint defect on the parts to be coated.

BRIEF SUMMARY

The object of the present disclosure is, therefore, to make suitable improvements to the known coating plant described at the outset.

This object is achieved by a coating plant and an associated coating process as described hereinbelow.

The present disclosure is based on the technical knowledge that the component load on the metering pump and the paint pressure regulator with the known coating plant described initially is caused by the falling differential pressure across the metering pump fluctuating severely during coating operations. With a high positive pressure differential (i.e. the pressure ahead of the metering pump is higher than the pressure behind the metering pump), this leads to a higher outflow rate with small changes in volumetric flow (known as brushes) than desirable, which is caused by pump slippage. With a negative pressure differential (I.e. the pressure ahead of the metering pump is lower than the pressure behind the metering pump), the fluctuations in the pressure differential result, in contrast, in an undersupply of the required paint volume, which in the worst case causes the disruptive cessations in paint flow. In addition, the fluctuations in the pressure differential across the metering pump also contribute to the undesirable mechanical loading of the metering pump and the paint pressure regulator.

The pressure differential across the metering pump and thus the disruptive metering inaccuracies and mechanical loading are not only affected by the fluctuating volume of the coating means dispensed. The pressure differential also changes with a switch to a coating means with a different viscosity or with the installation of a different paint pressure regulator with a different conversion ratio.

The present disclosure therefore embraces the general technical teaching of keeping the pressure differential across the metering pump during coating operations, independently of the volume of coating means dispensed, of the viscosity of the coating means and/or the pressure conversion ratio of the paint pressure regulator being used, as constant as possible in order to avoid the aforementioned negative effects on metering accuracy and the service life of the components being used.

The coating plant in accordance with the exemplary illustrations therefore has a control unit or feed-back unit which actuates the pressure regulator and adjusts the pressure differential across the metering pump as a control or feed-back variable to an essentially constant set-point value, independently of the flow rate of the metering pump. In the case of the exemplary illustrations, the pressure differential across the metering pump is therefore the control or feed-back variable, whereas in the case of the prior art described initially the outlet pressure of the pressure regulator or the volume of the paint flow was regulated.

Maintaining the pressure differential across the metering pump constant is preferably carried out by a control unit, i.e. without any measurement and feedback of the actual value of the pressure differential. The advantage of feed-forward control of the pressure differential in contrast to feedback control of the pressure differential is the absence of a tendency to fluctuate, the simple technical implementation, the rapid reaction to jumps in pressure and changes in paint volume and the possibility of compensating for the lag time of the proportional valve.

Within the scope of the exemplary illustrations, the possibility also exists of regulating the pressure differential across the metering pump by means of a regulating unit. This means that the actual value of the pressure differential across the metering pump is measured and sent to a regulator which then actuates the paint pressure regulator accordingly in order to adjust the pressure differential across the metering pump to the desired value. A regulator of this type can be a conventional PID regulator, but other types of regulator can be used within the scope of the exemplary illustrations.

The possibility further exists within the scope of the exemplary illustrations of combining closed-loop with open-loop control by superimposing a pilot control on the closed-loop control for example, which combines the advantage of closed-loop control on the one hand with open-loop control on the other.

In one example, parameter control is used to keep the pressure differential across the metering pump constant, i.e. no closed-loop control so that the actual value of the pressure differential across the metering pump does not have to be measured.

To do this in this illustration, a first pressure sensor is provided which measures the pressure of the coating means downstream after the metering pump, i.e. at the metering pump outlet. The coating means pressure measured at the metering pump outlet is sent to the control unit which actuates the pressure regulator as a function of the coating means pressure measured downstream after the metering pump such that the pressure differential across the metering pump assumes the set point value and remains constant.

In another exemplary illustration, the actuation of the pressure regulator by the control unit takes place indirectly through an interposed proportional valve which is known from the prior art mentioned at the outset. The proportional valve is actuated electrically by the control unit and in turn the valve actuates the paint pressure regulator pneumatically.

The controlling action of the control unit is determined by a substantially linear control characteristic where the control characteristic defines the connection between the pressure measured at the metering pump outlet and the resulting actuation variable for the pressure regulator, or the interposed proportional valve respectively. The linear control characteristic has a predetermined axis section value and a specified slope, where the axis section value is established preferably as a function of the desired set point value of the pressure differential across the metering pump and the actual pressure conversion ratio of the system from the proportional valve and the paint pressure regulator, while the slope of the control characteristic is preferably specified as a function of the conversion ratio of the system consisting of the proportional valve and the pressure regulator. The following may hold true for the control characteristic:

$$k_d = k_1 + k_2 \cdot p_H$$

with $k_d$: actuating variable to actuate the proportional valve $P_H$: pressure measured after the metering pump $k_1$: axis section value for the control characteristic $k_2$: gradient/slope of the control characteristic.

The control parameters k1 and k2 of the control characteristic are adjusted as follows to set the desired pressure differential across the metering pump:

$$k1 = \frac{\Delta pSoll}{\eta}$$

$$k2 = \frac{1}{\eta}$$

with $\Delta P_{Soll}$: set point value for the differential pressure across the metering pump, $\eta$: conversion ratio of the system from the pressure regulator and the upstream proportional valve.

When the control parameters k1, k2 are set to the aforementioned values, the desired differential pressure across the metering pump adjusts itself independently of the flow rate, as results from the following formula:

$$\begin{aligned}\Delta p &= pV - \mathrm{pH}\\ &= \eta \cdot kd - \mathrm{pH}\\ &= \eta \cdot (k1 + k2 \cdot \mathrm{pH}) - \mathrm{pH}\\ &= \eta \cdot k1 + (\eta \cdot k2 - 1) \cdot \mathrm{pH}\\ &= \Delta p_{Soll}\end{aligned}$$

The exact adjustment of the optimal control parameters k1, k2 presupposes knowledge of the conversion ratio $\eta$ for the system consisting of the proportional valve and the pressure regulator. If the pressure regulator is replaced or a change is made to a coating means with a different viscosity, the conversion ratio $\eta$ is not known, so that the control parameters k1, k2 have to be determined. Determination of the control parameters k1 and k2 preferably takes place as part of an adaptation wherein the coating medium pressure upstream of the metering pump is measured and evaluated. The adaptation of the controlling action is then carried out through an adaptation unit which is connected on the inlet side to the two pressure sensors and the controlling action of the control unit is adapted as a function of the coating means pressure measured upstream ahead of the metering pump and the coating means pressure measured downstream behind the metering pump.

Adaptation of the controlling action of the control unit preferably takes place iteratively and/or recursively. Iterative adaptation of the controlling action means that the controlling action is approximated to the ideal controlling action in several successive steps which is necessary in order to keep the pressure differential across the metering pump constant. Recursive adaptation in the sense of the exemplary illustrations generally means that improved controlling action is calculated at anyone time from the current controlling action of the control unit.

Adaptation of the controlling action of the control unit can take place during normal coating operations or in separate adaptation phases. In addition, adaptation can take place during normal coating operations continuously or at specific intervals.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
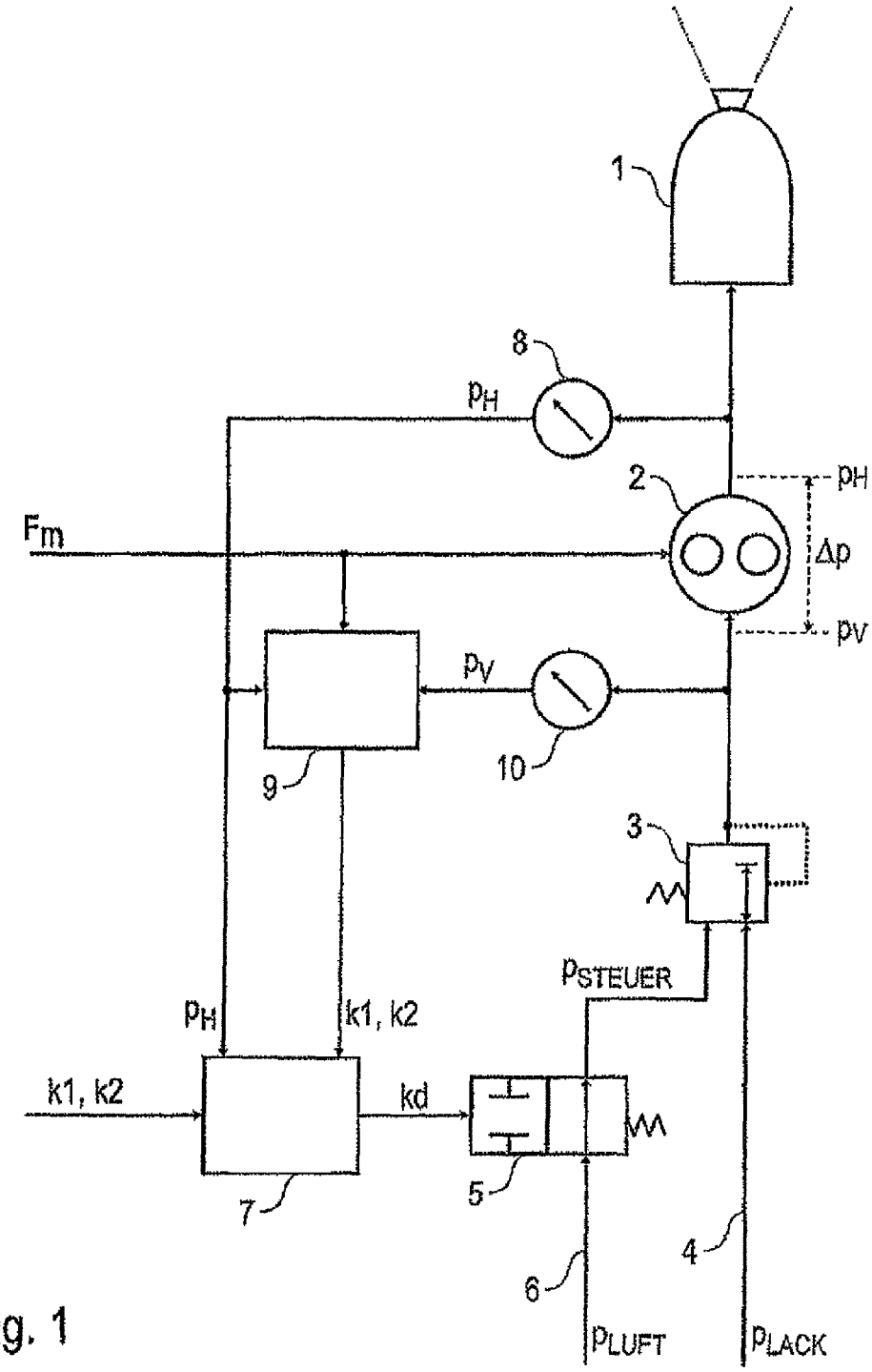
FIG. 1 is a schematic representation of a coating plant according to one embodiment of the invention.

The coating plant in accordance with the example shown schematically in FIG. 1 is partly identical to the prior art described at the outset in accordance with EP 1 287 900 A2 and has a conventional atomizer which is supplied with paint through a volumetric metering pump 2, where the metering pump 2 is connected through a paint pressure regulator 3 to a paint line 4 which provides a paint pressure $p_{Lack} \approx 8$ bar.

The paint pressure regulator 3 can be configured conventionally, described, for example, in EP 1 376 289 A 1 so that the content of this publication is incorporated in its entirety in the present description.

During operation the paint pressure regulator 3 at the inlet of the metering pump 2 controls a paint pressure $P_v$ as a function of a control pressure $p_{STEUER}$ which is supplied to the paint pressure regulator 3 through a proportional valve 5, where the proportional valve 5 is connected to a control air line 6 which provides a control air pressure $p_{LUFT} \approx 0$ bar.

The proportional valve 5 is actuated by a control unit 7 with an electrical actuation signal kd where the system consisting of the proportional valve 5 and the paint pressure regulator 3 has a conversion ratio $\eta = p_v/kd$, i.e. when the proportional valve is actuated with the electrical actuation signal kd, a coating means pressure $p_v$=kd·η is achieved at the outlet of the paint pressure regulator 3.

When the proportional valve 5 is actuated, the control unit takes into account the coating means pressure PH at the outlet of the metering pump 2, where the pressure PH is measured by a pressure sensor 8. Actuation of the proportional valve 5 by the control unit 7 then takes place in accordance with the following linear control characteristic:

$$kd=k1=K2\cdot p_H$$

The control parameters k1 and k2 are adjusted as follows:

$$k1=\frac{\Delta pSoll}{\eta}$$

$$k2=\frac{1}{\eta}$$

With optimal adjustment of the control parameters k1, k2, the desired pressure differential $\Delta p_{Soll}$ across the metering pump 2 is set, as becomes clear from the following derivation:

$$\begin{aligned}\Delta p &= pV-\mathrm{pH}\\ &= \eta\cdot kd-\mathrm{pH}\\ &= \eta\cdot(k1+k2\cdot\mathrm{pH})-\mathrm{pH}\\ &= \eta\cdot k1+(\eta\cdot k2-1)\cdot\mathrm{pH}\\ &= \Delta p_{Soll}\end{aligned}$$

Determining the optimal values for the control parameters k1 and k2 presupposes knowledge of the conversion ratio η of the system consisting of the proportional valve 5 and the paint pressure regulator 3. After replacing the paint pressure regulator 3 with another paint pressure regulator having a different pressure conversion ratio, the control parameters k1, k2 therefore have to be adapted to the altered pressure conversion ratio of the paint pressure regulator 3. Also, when changing the coating means used and a resulting change in the viscosity of the coating means, the conversion ratio η changes, which also necessitates adaptation of the control parameters k1, k2.

Figure 2:
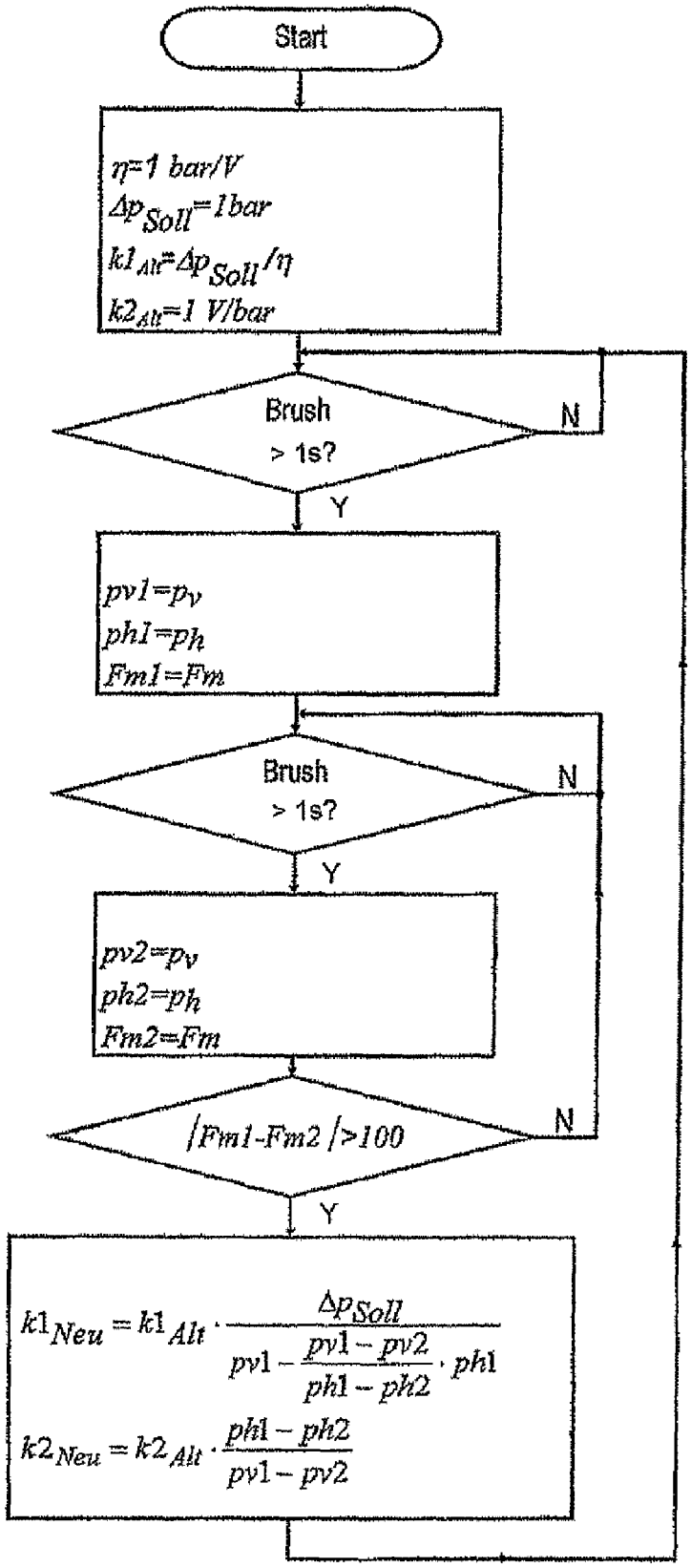
FIG. 2 is a simplified schematic flow diagram of the adaptation procedure according to one embodiment of the invention for the adjustment of the control behavior.
Figure 3:
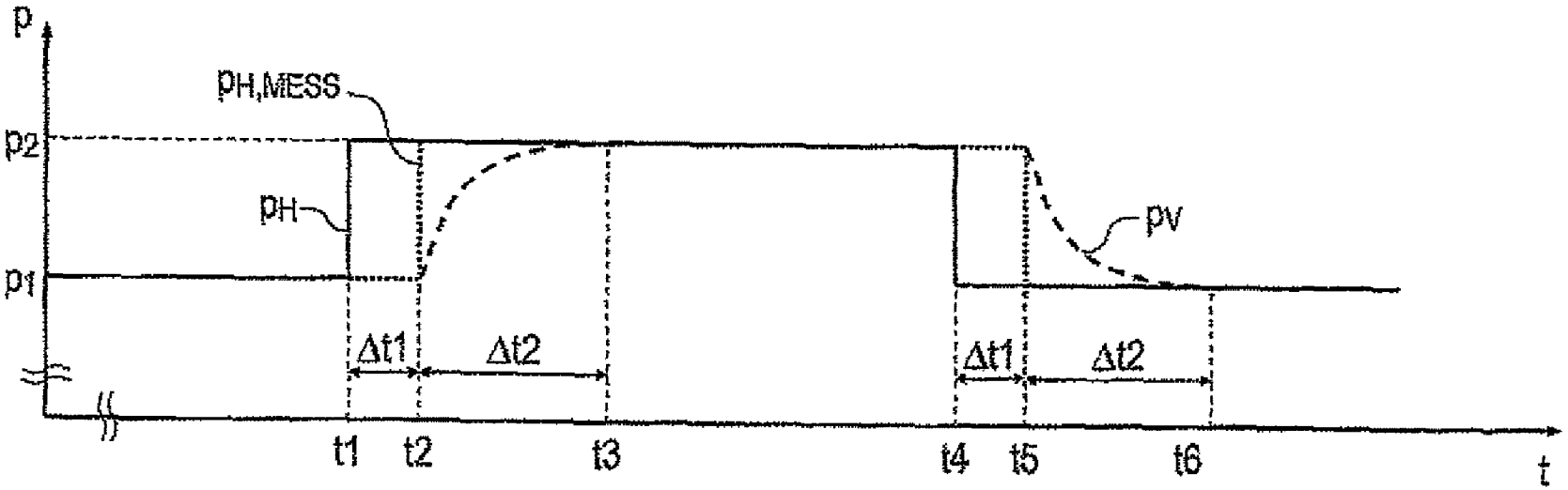
FIG. 3 is a graph of time versus pressure.
Figure 4:
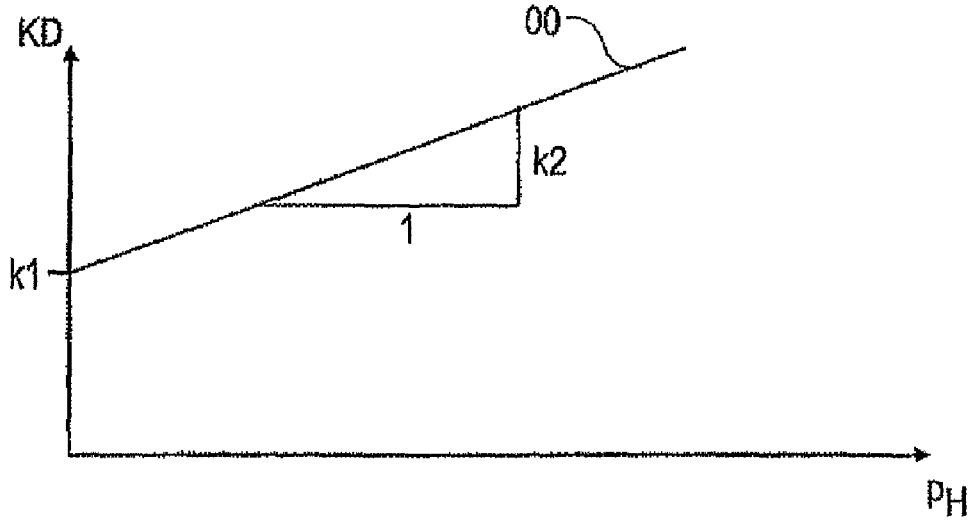
FIG. 4 is a graph of pressure verses electrical control signal.

The coating plant in accordance with the exemplary illustrations therefore has an adaptation unit 9 which is connected to the pressure sensor 8 and in addition measures the coating medium pressure pvahead of the metering pump through a further pressure sensor 10. The adaptation unit 9 then adapts the control parameters k1, k2 as part of an adaptation process which is shown in FIG. 2 in the form of a flow chart and is described hereinafter.

During the initial adaptation of the control parameters, the values for the conversion ratio η, the set point value for the pressure differential across the metering pump 2 and the starting values $k1_{Alt}$ and $k2_{Alt}$ for the control parameters k1 and k2 are initialized, where the specifications are based on speculations about the conversion ratio η.

Then a so-called brush which lasts longer than one second is awaited. This is a change in the volumetric flow in the stream of coating means dispensed which is based on the main needle of the atomizer 1 opening. Taking only relatively long-lasting brushes with a duration of more than 1 second into consideration makes sense because the duration of shorter brushes is not sufficient to allow transient effects to die away.

Then the adaptation unit 9 measures the pressure $P_{V1}$ ahead of the metering pump 2 and the pressure $P_{H1}$ behind the metering pump through the two pressure sensors 8, 10. In addition, the adaptation unit also registers the paint volume $F_{m1}$ in this initial operating point. The values $P_{V1}$, $P_{V2}$ and $F_{m1}$ are available in the controls anyway and so do not have to be measured additionally.

Then the next brush is awaited which lasts for longer than one second and is thus no longer affected by transient effects.

At this second operating point, the values $p_{V2}$, $p_{H2}$ and $F_{m2}$ for the pressure $p_v$ ahead of the metering pump, the pressure $P_H$ after the metering pump and paint volume $F_m$ are again read out of the controls and saved. Here too, the fact can be utilized that the values $P_{V2}$, $P_{H2}$ and $F_{m2}$ are available anyway and so do not have to be measured additionally.

Then a check is made whether the two operating points are sufficiently far removed from each other to permit a meaningful measurement. To do this, the absolute value of the difference $F_{m1-Fm2}$ of the paint volumes measured at the two operating points pulled up for the adaptation is created and compared with a minimum value. If the interval thus formed between the two operating points is too small, the second operating point is rejected.

Otherwise optimized values $k1_{NEU}$ and $k2_{NEU}$ are then calculated from the previous values $k1_{Alt}$ and $k2_{Alt}$ for the control parameters according to the following formulae:

$$k2_{Neu}=k2_{Alt}\cdot\frac{\mathrm{pH1}-\mathrm{pH2}}{pV1--pV2}$$

$$k1Neu=k1Alt\frac{\Delta pSOLL}{pV1-\frac{pV1-pV2}{\mathrm{pH1}-\mathrm{pH2}}\cdot\mathrm{pH1}}$$

Afterwards, the control unit 7 works with the optimized values $k1_{NEU}$ and $k2_{NEU}$ for the control parameters, where the adaptation of the control parameters k1, k2 shown in FIG. 2 is continuously repeated during coating operations to optimize the controlling action of the control unit 7 and to keep the pressure differential Δp across the metering pump 2 adhering as closely as possible to the specified set point value ΔpSoll.

The aforementioned formulae for the adaptation of the control parameters k1, k2 result from the following mathematical-physical derivation.

First, the action of the coating plant is described by the following equations:

$$kd=k1+k2\cdot pH \tag{1}$$

$$pV=kd\cdot\eta \tag{2}$$

$$\Delta p=pV-pH \tag{3}$$

with:

kd: actuation variable for actuating the proportional valve 5, $p_v$ pressure measured ahead of the metering pump 2, $P_H$: pressure measured after the metering pump 2, k1: axis intersect value for the control characteristic curve, k2: slope of the control characteristic curve, ΔSoll: set point value for the pressure differential across the metering pump 2, Δp: actual value for the pressure differential across the metering pump 2, η: conversion ratio of the system consisting of the pressure regulator 3 and the upstream proportional valve 5.

It follows from equations (1) and (2):

$$pV=(k1+k2)\cdot\eta \tag{4}$$

If one observes two operating points with different volumes of paint $F_{m1}$, $F_{m2}$ and different coating means pressures $P_{V1}$, $P_{V2}$, $P_{H1}$ and $P_{H2}$ ahead of, or after the metering pump respectively, according to equation (4) the following applies to these two operating points:

$$pV1=(k1+k2\cdot pH1)\cdot\eta \tag{5}$$

$$pV2=(k1+k2\cdot pH2)\cdot\eta \tag{6}$$

From equations (5) and (6) it then follows for the control parameter k2:

$$k2=\frac{pV1-pV2}{\eta\cdot(\mathrm{pH1}-\mathrm{pH2})} \tag{7}$$

For the old non-optimized value $k2_{Alt}$ of control parameter k2 this applies directly:

$$k2Alt=\frac{pV1-pV2}{\eta\cdot(\mathrm{pH1}-\mathrm{pH2})} \tag{8}$$

For the new optimized value $k2_{Neu}$ for control parameter k2, then the following holds true in consideration of the equation (3) satisfied under optimized controlling action:

$$k2Neu=\frac{(\mathrm{pH1}+\Delta p)-(\mathrm{pH2}+\Delta p)}{\eta\cdot(\mathrm{pH1}-\mathrm{pH2})} \tag{9}$$

The adaptation formula for the adaptation of control parameter k2 follows from equations (8) and (9):

$$k2Neu=k2Alt\cdot\frac{\mathrm{pH1}-\mathrm{pH2}}{pV1-pV2} \tag{10}$$

In the following, the derivation of the adaptation formula for control parameter k1 is described. It follows from equations (1), (2) and (3):

$$k1=\frac{pV}{\eta}-k2\cdot\mathrm{pH} \tag{11}$$

If equation (6) is inserted into equation (11), the result is I obtains for the old, non-optimized value k1Alt of control parameter k1 in operating point 1 with pV1, pH1 and Fm1:

$$k1_{Alt}=\frac{p_{V1}}{\eta}-\frac{p_{V1}-p_{V2}}{\eta\cdot(p_{H1}-p_{H2})}\cdot p_{H1} \tag{12}$$

For the new adapted optimal value $k1_{Neu}$ on the other hand:

$$k1_{Neu}=\frac{\Delta p_{Soll}}{\eta} \tag{13}$$

must hold true.

From the equations (12) and (13) follow then finally the adaptation formula for the adaptation of the control parameter k1:

$$k1_{Neu}=k1_{Alt}\frac{\Delta p_{SOLL}}{p_{V1}-\frac{p_{V1}-p_{V2}}{p_{H1}-p_{H2}}\cdot p_{H1}} \tag{13}$$

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A coating installation for the coating of construction units with a coating medium, comprising:

a dosing pump configured to supply a predetermined quantity of the coating medium to an application device configured to apply the coating medium;

a pressure regulator disposed upstream of the dosing pump, the pressure regulator configured to set a desired coating medium pressure at an input of the dosing pump;

a first pressure sensor configured to measure a first coating medium pressure downstream of the dosing pump;

a second pressure sensor configured to measure a second coating medium pressure upstream of the dosing pump;

a control unit configured to control the pressure regulator to set a desired pressure difference across the dosing pump independent of the predetermined quantity conveyed by the dosing pump, wherein the control unit is configured to control the pressure regulator as a function of at least the first coating medium pressure and a feedback of a measured pressure difference across the dosing pump, such that the measured pressure difference across the dosing pump assumes the desired pressure difference, wherein the desired pressure difference across the dosing pump is substantially constant and in the range between 0.5 bars and 1.5 bars; and an adaptation unit in communication with the two pressure sensors, the adaptation unit configured to adjust the control unit as a function of at least the first coating medium pressure and the second coating medium pressure.

2. The coating installation of claim 1, wherein the control unit is configured to control a pressure control valve as a function of the coating medium pressure measured downstream behind the dosing pump according to a substantially linear control characteristic.

3. The coating installation of claim 2, wherein that the control characteristic includes a predetermined axis intercept value and a predetermined gradient, whereby the axis intercept value corresponds to a predetermined desired value of the pressure difference through the pressure control valve.

4. The coating installation of claim 1, wherein the adaptation unit is configured to influence a control of the control unit at least one of iteratively and recursively.

5. The coating installation of claim 1, wherein the adaptation unit is configured to influence a control of the control unit while a coating process takes place.

6. The coating installation of claim 1, wherein the adaptation unit is configured to influence a control of the control unit constantly at a predetermined time interval.

7. The coating installation of claim 1, wherein the control unit is configured to interact with a pressure control valve directly without an interposed control loop.

8. The coating installation of claim 1, wherein the pressure difference has a tolerance range of +/−1 bar.

9. The coating installation of claim 1, wherein the control unit controls a pressure control valve via a proportional valve, wherein the control unit controls the proportional valve electrically, while the proportional valve controls the pressure control valve pneumatically.

10. The coating installation of claim 1, wherein the dosing pump is configured to feed application equipment with the coating medium.

11. The coating installation of claim 1, wherein the application device includes a rotary atomizer.

12. The coating installation of claim 1, further comprising a paint system for a lacquer finish of motor vehicle body parts.

* * * * *